US006470786B2

(12) United States Patent
Uski

(10) Patent No.: US 6,470,786 B2
(45) Date of Patent: Oct. 29, 2002

(54) RADIAL PISTON HYDRAULIC ENGINE

(75) Inventor: Matti Uski, Jyväskylä (FI)

(73) Assignee: Santasalo Hydraulics Oy, Jyvaskyla (FI)

( * ) Notice: Subject to any disclaimer, the term of this patent is extended or adjusted under 35 U.S.C. 154(b) by 0 days.

(21) Appl. No.: 09/733,502

(22) Filed: Dec. 8, 2000

(65) Prior Publication Data

US 2001/0003948 A1 Jun. 21, 2001

(30) Foreign Application Priority Data

Dec. 8, 1999 (FI) ..... 992631

(51) Int. Cl.[7] ..... F01B 1/06

(52) U.S. Cl. ..... 91/498; 91/497; 91/476; 91/491

(58) Field of Search ..... 91/498, 497, 476, 91/491

(56) References Cited

U.S. PATENT DOCUMENTS

| | | | | |
|---|---|---|---|---|
| 3,286,638 A | * | 11/1966 | Daubin | 91/491 |
| 4,072,445 A | * | 2/1978 | Hay | 417/379 |
| 5,439,356 A | * | 8/1995 | Grahl | 417/273 |
| 5,836,231 A | | 11/1998 | Leinonen | 91/491 |

FOREIGN PATENT DOCUMENTS

| | | |
|---|---|---|
| FI | 104014 | 11/1995 |

* cited by examiner

*Primary Examiner*—Cheryl J. Tyler
*Assistant Examiner*—Michael K. Gray
(74) *Attorney, Agent, or Firm*—Steinberg & Raskin, P.C.

(57) ABSTRACT

The invention concerns a radial piston hydraulic engine (10), which includes a rotated box section (11), with which box section (11) a cam ring (12) is connected. The radial piston hydraulic engine (10) includes a fixed non-rotary shaft (14), with which a cylinder body (15) in a fixed position is connected. The radial piston hydraulic engine includes a distributor (13), which is connected with the box section (11) and rotates together with it, whereby through channels located in the distributor a pressurised medium is conducted to pistons (16$a_1$, 16$a_2$ . . . ) of cylinders ($P_1$, $P_2$ . . . ) controlled by the distributing valve, that is, by distributor (13), and that at least some cylinders ($P_1$, $P_2$ . . . ) include in connection with themselves a shut-off valve (70$a_1$, 70$a_2$ . . . ), which is used to make some pistons (16$a_1$, 16$a_2$ . . . ) inoperative. Shaft (14) includes in the same cylinder block (I) at least two control pressure channels ($Y_1$, $Y_2$) for the shut-off valves (70$a_1$, 70$a_2$) of its cylinder body (15), whereby by supplying pressure selectively into a channel ($Y_1$ or $Y_2$; $Y_1$ and $Y_2$) it is possible to make certain cylinders ($P_1$, $P_2$ . . . ) inoperative by directing control pressure to the shut-off valves (70$a_1$, 70$a_2$, 70$a_3$ . . . ).

5 Claims, 7 Drawing Sheets

RADIAL PISTON HYDRAULIC ENGINE

FIELD OF THE INVENTION

This invention concerns a radial piston hydraulic engine.

BACKGROUND OF THE INVENTION

Such radial piston hydraulic engine solutions are known in the state of the art, wherein a box section is rotated and to the box section is joined a distributor mounted to the same. The distributor is a so-called distributing valve, which includes borings made in the direction of the distributor bushing and opening from the distributor's end face. There are inlet channels to the distributor and outlet channels from it. The inlet channels open in the distributor's end face, as do the outlet channels. The respective channels of the distributing valve are alternately in connection with piston spaces, which piston spaces include pistons and pusher wheels connected with the pistons and adapted to move against a cam ring located in connection with the box section. Under these circumstances, some pistons are in the work stage and some are not. Those pistons which are in the work stage are supplied with a pressurised medium through the distributor's channels and, correspondingly, those pistons which have bypassed the work stage remove oil through the distributor by way of the outlet channels of the distributor. The pusher wheels located in the pistons push against the cam ring located in the box section. The cam ring includes a wavelike shape, whereby the cam ring and the box section connected to it are rotated with the aid of the pusher wheels. To ensure optimum operation of the distributor, the distributor's end face must be in a tight slide fit against that end face of the cylinder body wherein the channels leading to the piston spaces are located.

OBJECTS AND SUMMARY OF THE INVENTION

The application presents an improvement especially on the solution presented in the applicant's earlier FI 942304 application. The structure according to the invention is especially concerned with such a radial piston hydraulic engine, wherein the cylinder body and the shaft 14 are immovably connected to one another, e.g. by a groove coupling, and in which structure the cylinder body and its associated shaft are non-rotary. In accordance with the invention, those cylinder spaces $P_1$, $P_2$ . . . of the cylinder body, which are connected with cylinder block 1, in connection with themselves include oil channels, which are further connected with the distributor in the end face of the cylinder body. In some of these cylinder body channels shut-off valves are located, which are controlled by pressure. According to the invention, the shut-off valves are pre-controlled as follows. A channel boring is made through the shaft, and from the boring in question a control is branched off into certain cylinder spaces and into the shut-off valves located in connection with these. The structure according to the invention includes at least one other boring, from which controls are branched off to other piston spaces of the cylinder block and into their shut-off valves. Some of the channels connected with cylinder spaces in the cylinder body are such which do no include shut-off valves, and pressurised oil is also conducted to these in operation. Thus, by using the control channels selectively, different connections and thus different combinations of volume flows are achieved.

The radial piston hydraulic engine in accordance with the invention is characterised in that which is stated in the claims.

BRIEF DESCRIPTION OF THE DRAWINGS

The invention will be described in the following by referring to some preferable embodiments of the invention, which are shown in the figures of the appended drawings, however, to which the invention is not intended to be exclusively limited.

FIG. 3A is a cross-section of the radial piston hydraulic engine, and FIG. 3B is a section I—I of FIG. 3A. Regulation variations are shown in corresponding sections I—I in FIGS. 4, 5A and 5B.

DETAILED DESCRIPTION OF THE INVENTION

Figure 1:
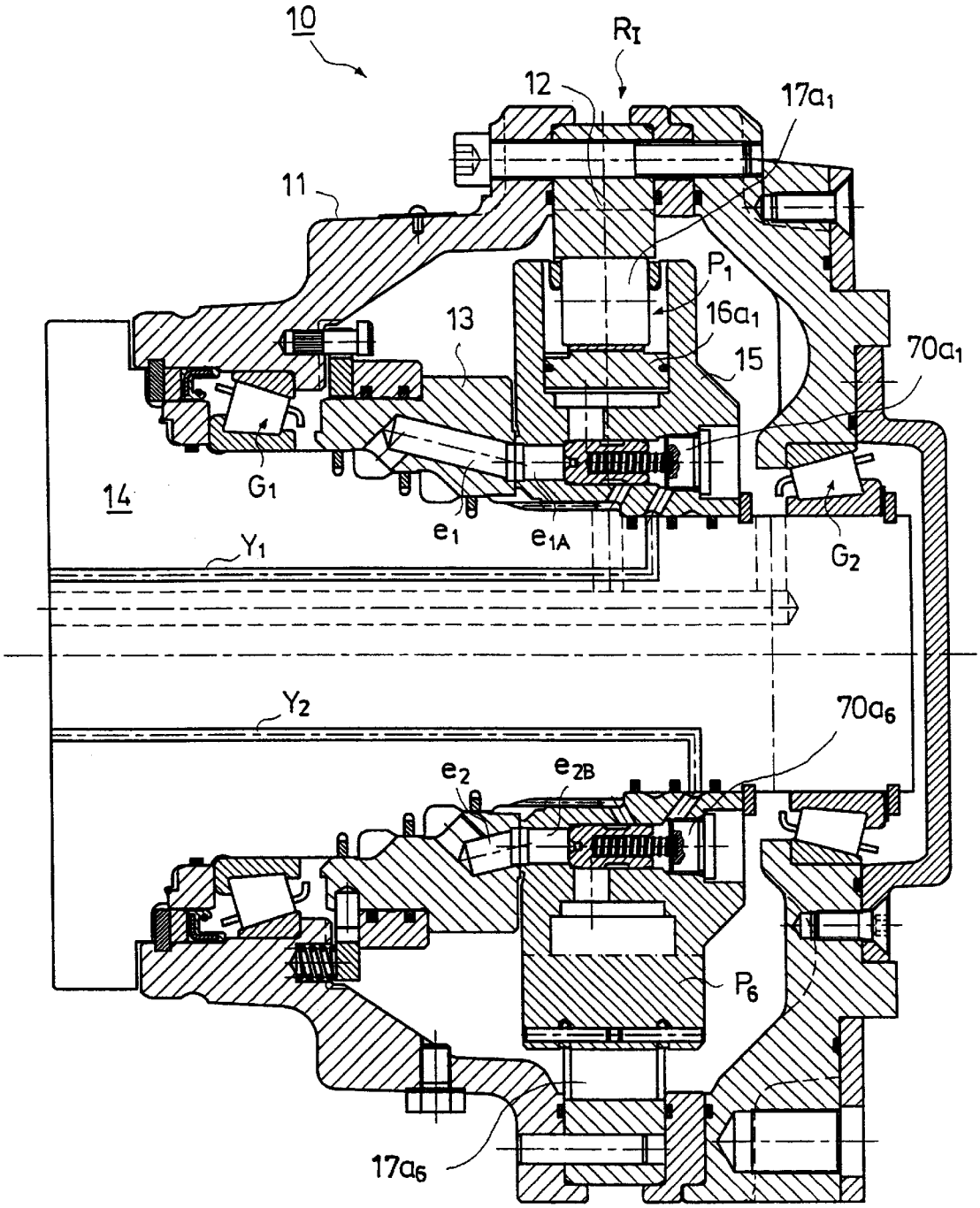
FIG. 1 is a cross-sectional view of the radial piston hydraulic engine according to the invention.

FIG. 1 is a cross-sectional view of radial piston hydraulic engine 10. The radial piston hydraulic engine 10 includes a rotated box section 11. A cam ring 12 is connected to box section 11. In the embodiment shown in the figure, box section 11 is rotated, to which box section a distributor 13 is connected, which is in a fixed position in relation to box section 11. Distributor 13 is a distributing valve including several borings $e_{1A}$; $e_{2B}$, which are in connection with the inlet channel $e_1$ and with the outlet channel $e_2$ of a central shaft 14. Distributor 13 rotates with the box section 11, and the pressurised channels $e_{1A}$ and return oil channels $e_{2B}$ are brought alternately into contact with the channel ends of those flow channels of cylinder pistons 16$a_1$, 16$a_2$ . . . located in cylinder body 15, which lead to the cylinder spaces of cylinders $P_1$, $P_2$ . . . Under these circumstances, some of the pistons 16$a_1$, 16$a_2$ . . . of cylinders $P_1$, $P_2$ . . . are in the work stage, whereby pressurised medium is conducted through distributor 13 to cylinders $P_1$, $P_2$ . . . to some of said pistons 16$a_1$, 16$a_2$ . . . through said inlet channels $e_1$ and some pistons 16$a_1$, 16$a_2$ . . . are in the idle stage, whereby oil is conducted from the cylinder spaces of the cylinders $P_1$, $P_2$ . . . of the said pistons 16$a_1$, 16$a_2$ . . . through distributor 13 to outlet channel $e_2$. The non-rotary cylinder body 15 located in the non-rotary central shaft 14 includes a cylinder block $R_1$, whereby cylinder body 15 contains several cylinder spaces $P_1$, $P_2$ . . . and pistons 16$a_1$, 16$a_2$ . . . in these. Piston 16$a_1$, 16$a_2$ . . . is adapted to move in the cylinder space of cylinder $P_1$, $P_2$ . . . under the influence of the oil pressure supplied thereto. As shown in the figure, each piston 16 includes a pusher wheel 17$a_1$, 17$a_2$ . . . with a circular cross-section and placed freely on its top surface. When pushing piston 16$a_1$, 16$a_2$ . . . forced against the wavelike surface 12$a$ of cam ring 12, cam ring 12 and the connected box section 11 and the distributing valve, that is distributor 13, connected with box section 11 are made to rotate.

Box section 11 is pivoted to rotate supported by bearings $G_1$ and $G_2$ in relation to the central shaft 14.

As shown in FIG. 1, the cylinder body in connection with the piston spaces includes pressure-controlled shut-off valves 70$a_1$, 70$a_2$ . . . , whereby by using the shut-off valves 70$a_1$, 70$a_2$ . . . it is possible to shut off the supply of pressurised oil to the cylinder spaces of cylinders $P_1$, $P_2$ . . . and thus to remove from operation the piston connected with the cylinder space in question. The volume flow of the engine can be regulated by directing the supply of control pressure to the shut-off valves 70$a_1$, 70$a_2$ . . . located in the cylinder body.

The radial piston hydraulic engine shown in FIG. 1 includes a channel $Y_1$, through which control pressure is conducted to shut-off valves 70$a_1$, 70$a_3$, 70$a_5$, 70$a_7$, 70$a_9$ and 70$a_{11}$, which shut-off valves are further connected with cylinders $P_1$, $P_3$, $P_5$, $P_7$, $P_9$ and $P_{11}$. Correspondingly, oil channel $Y_2$ is connected with shut-off valves 70$a_2$, 70$a_6$ and 70$a_{10}$ to turn off or to turn on the operation of pistons $P_2$, $P_6$, $P_{10}$ connected with the said cylinders.

Cylinders $P_4$, $P_8$ and $P_{12}$ do not in connection with themselves include shut-off valves 70, whereby they are always in operation. Thus, the radial piston hydraulic engine in accordance with FIG. 1 preferably in the cylinder block includes a total of 12 cylinders; cylinders $P_1$, $P_2$ . . . $P_{12}$. The number of cylinders $P_1$, $P_2$ . . . may also be a multiple of 12.

Figure 2:
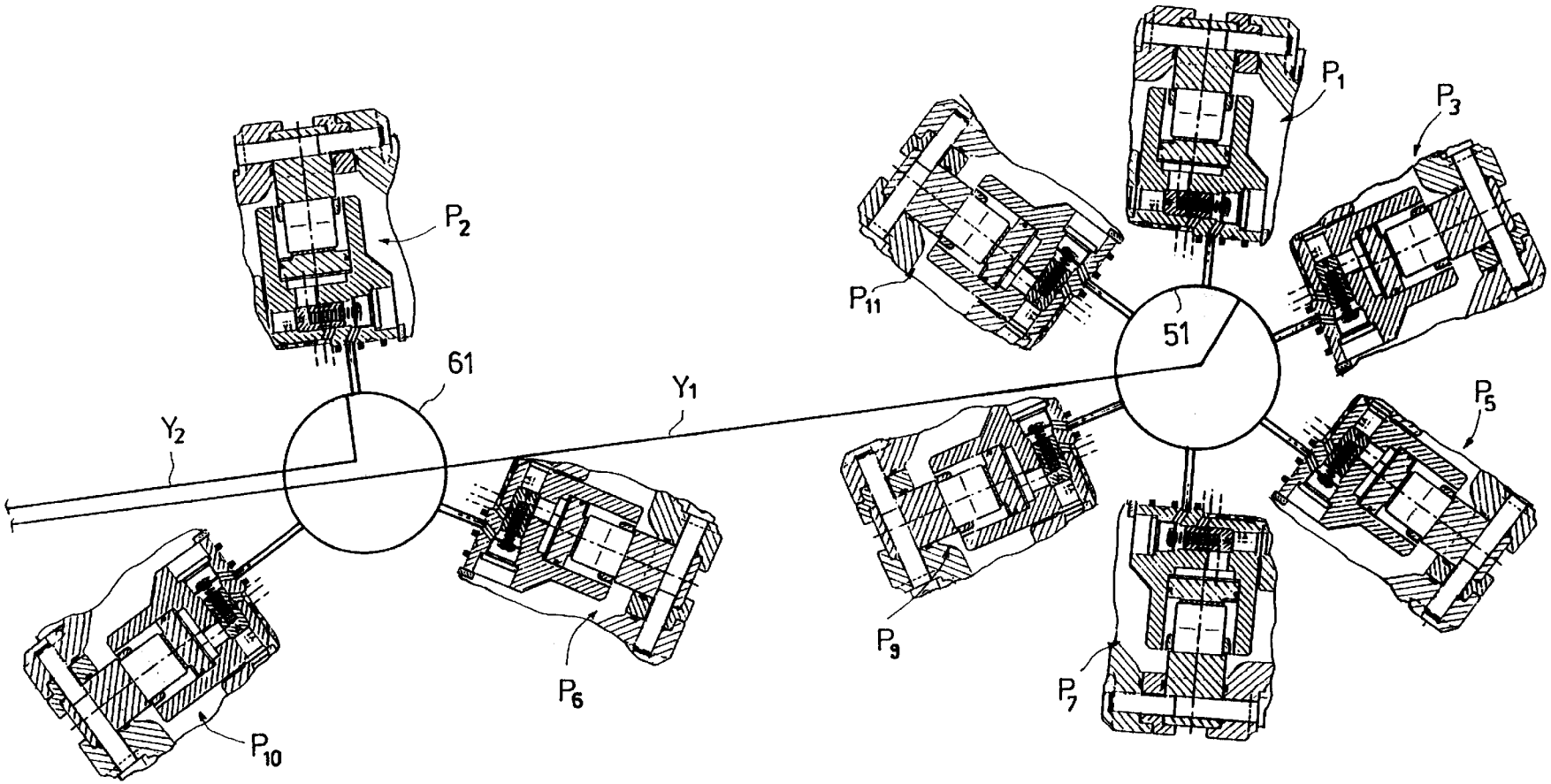
FIG. 2 illustrates the use of channels Y1 and Y2 located in shaft 14 in order to bring about control of the shut-off valves located in the cylinder body.

FIG. 2 illustrates the control operation of shut-off valve 70$a_1$, 70$a_2$ . . . so that through control channel $Y_1$ a control pressure is conducted to the shut-off valve in order to close it. Channel $Y_1$ opens into ring space 51, into which ring space also open e.g. the control channels of shut-off valves connected with six different pistons. Thus, by letting pressure affect in channel $Y_1$ shut-off valves 70$a_1$, 70$a_3$, 70$a_5$, 70$a_7$, 70$a_9$ and 70$a_{11}$ are controlled at the same time and the flow path to cylinders $P_1$, $P_3$, $P_5$, $P_7$, $P_9$ and $P_{11}$ is closed for the pressurised medium at its operating pressure. Correspondingly, through the other channel $Y_2$ control pressure can be conducted into the other ring space 61 and further, as illustrated in the figure, to three different shut-off valves 70$a_2$, 70$a_6$, 70$a_{10}$, which are located in the cylinder body in connection with the oil channel leading to cylinders $P_2$, $P_6$, $P_{10}$.

Correspondingly, to some cylinders $P_4$, $P_5$, $P_{12}$ pressurised oil is conducted directly from distributor 13 in such a way that there is no shut-off valve in connection with the channels of the concerned cylinder spaces.

In this way, by using control into channels $Y_1$ and/or $Y_2$ shut-off valves 70$a_1$, 70$a_2$ . . . can be controlled and an operating pressure is obtained for the desired cylinders $P_1$, $P_2$ . . . . When there are 12 pistons, the following volume flow combinations of ¼, ½, ¾ and 1 revolution volume are obtained.

Figure 3B:
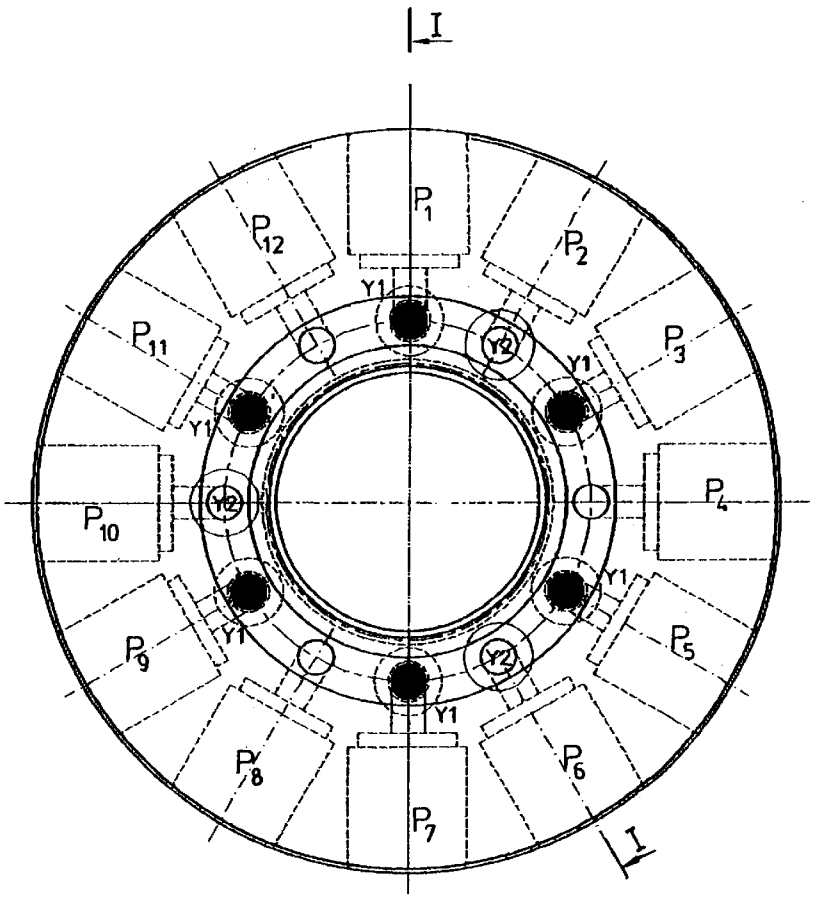
FIGS. 3A and 3B show a ½ revolution volume regulation implemented in a radial piston hydraulic engine according to the invention which includes 12 cylinders.
Figure 3A:
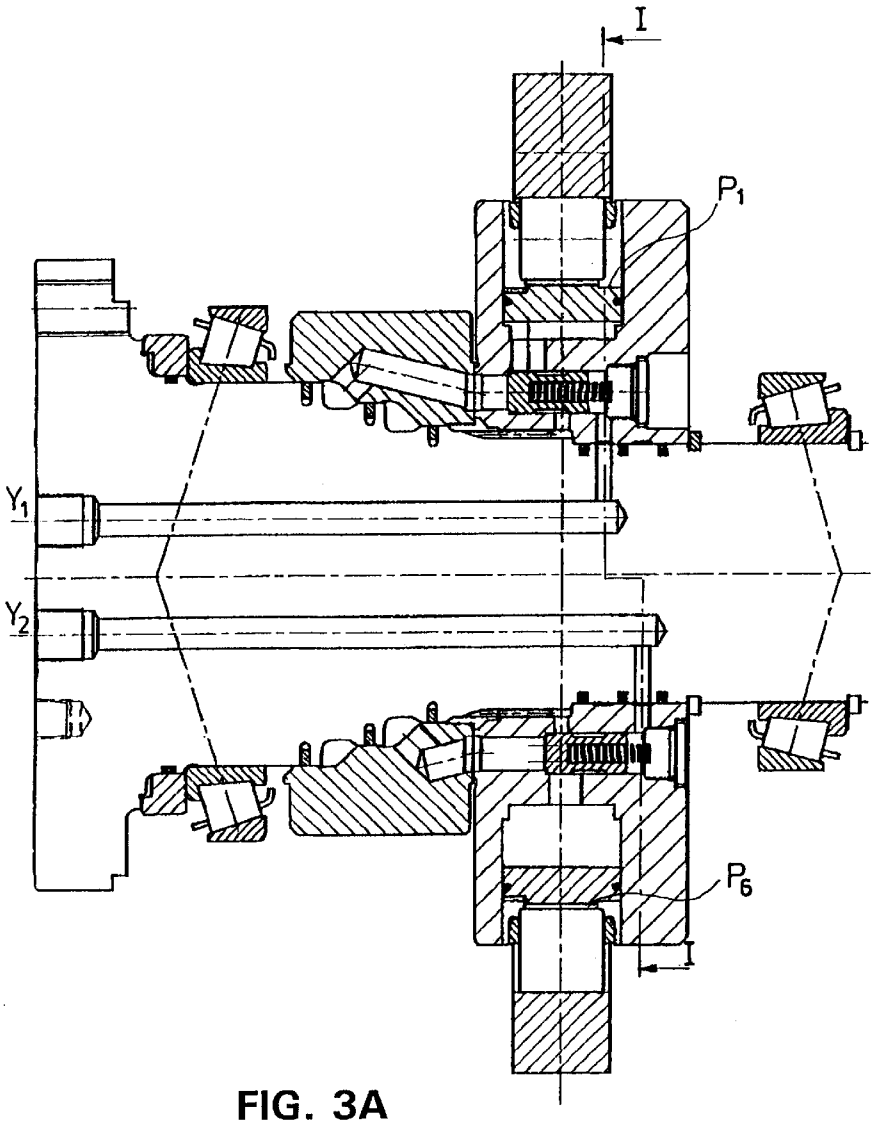

FIGS. 3A and 3B show ½ revolution regulation. FIG. 3B is a section I—I of FIG. 3A. The cylinder block includes 12 cylinders, cylinders $P_1$, $P_2$, $P_3$ . . . $P_{12}$. FIG. 3 shows darkened cylinders $P_1$, $P_3$, $P_5$, $P_7$, $P_9$ and $P_{11}$, which are in connection with channel $Y_1$, whereby a control pressure is conducted to channel $Y_1$. Cylinders $P_1$, $P_3$, $P_5$, $P_7$, $P_9$, and $P_{11}$ are divided equally by 60° in relation to one another in the cylinder block.

Cylinders $P_2$, $P_6$, $P_{10}$ in connection with channel $Y_2$ are divided by 120° in relation to one another. Those cylinders which do not in connection with themselves include any shut-off valve in the cylinder body are also divided by 120° in relation to each other in the cylinder block $R_1$, and the cylinders in question are indicated by reference numbers $P_4$, $P_8$ and $P_{12}$ in FIG. 3.

The figure indicates a so-called ½ revolution volume regulation, wherein a pressure is supplied into channel $Y_1$. Cylinders $P_1$, $P_3$, $P_5$, $P_7$, $P_9$ and $P_{11}$ are closed and an operating pressure can be conducted to all other cylinders of the cylinder block, that is, to cylinders $P_4$, $P_8$ and $P_{12}$ and to cylinders $P_2$, $P_6$, $P_{10}$. Thus, six cylinders are operating and the other six are closed.

Figure 4:
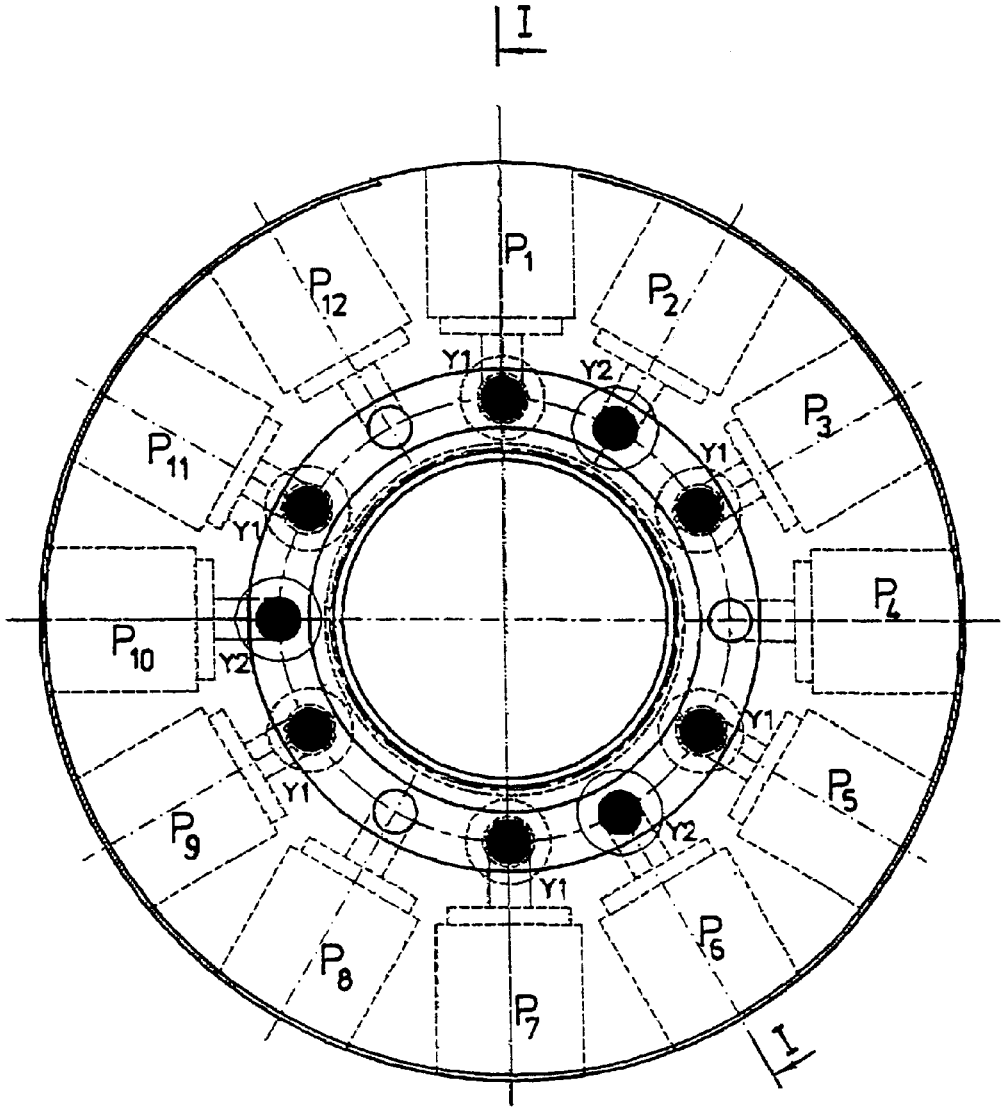
FIG. 4 shows so-called ¼ revolution volume regulation.

FIG. 4 shows so-called ¼ revolution volume regulation. Hereby the control pressure is supplied both through channel $Y_1$ and through channel $Y_2$, whereby the cylinders $P_1$, $P_3$, $P_5$, $P_7$, $P_9$ and $P_{11}$ connected to channel $Y_1$ are closed and, correspondingly, cylinders $P_2$, $P_6$, $P_{10}$ connected to channel $Y_2$ are closed. Instead, cylinders $P_4$, $P_8$ and $P_{12}$, which have no shut-off valve 70 connected to them, are operating.

Figure 5A:
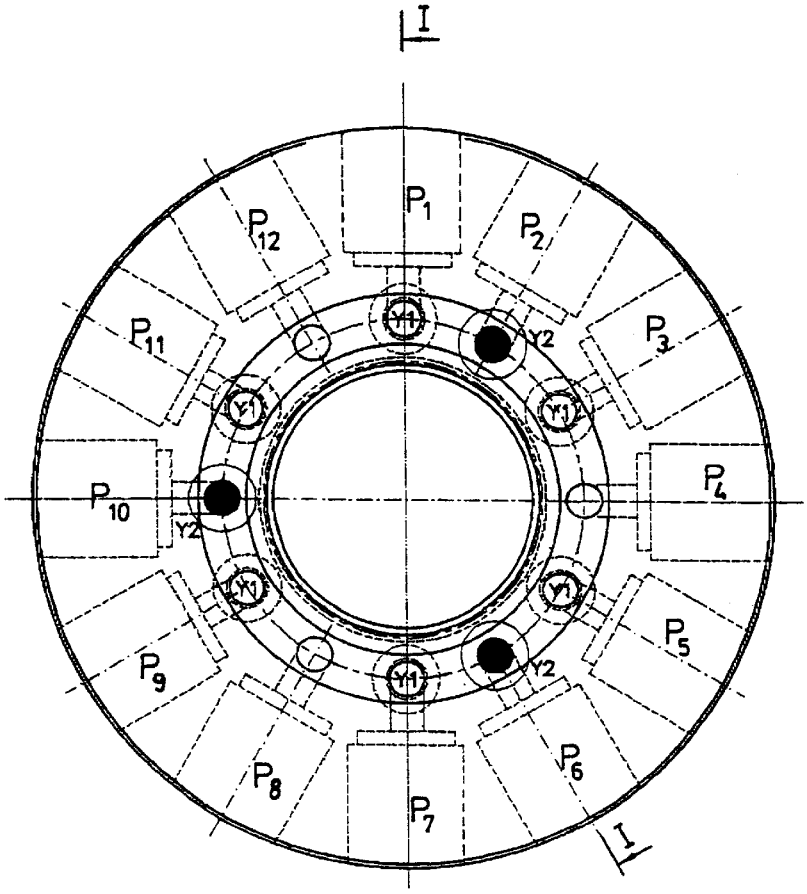
FIG. 5A shows so-called ¾ revolution volume regulation.

FIG. 5A shows so-called ¾ revolution volume regulation. In the regulation position concerned, a control pressure is supplied into channel $Y_2$ and thus to cylinders $P_2$, $P_6$, $P_{10}$. Hereby the said cylinders are in the closed state, whereas cylinders $P_1$, $P_3$, $P_5$, $P_7$, $P_9$ and $P_{11}$ as well as cylinders $P_4$, $P_8$ and $P_{12}$ are operated.

Figure 5B:
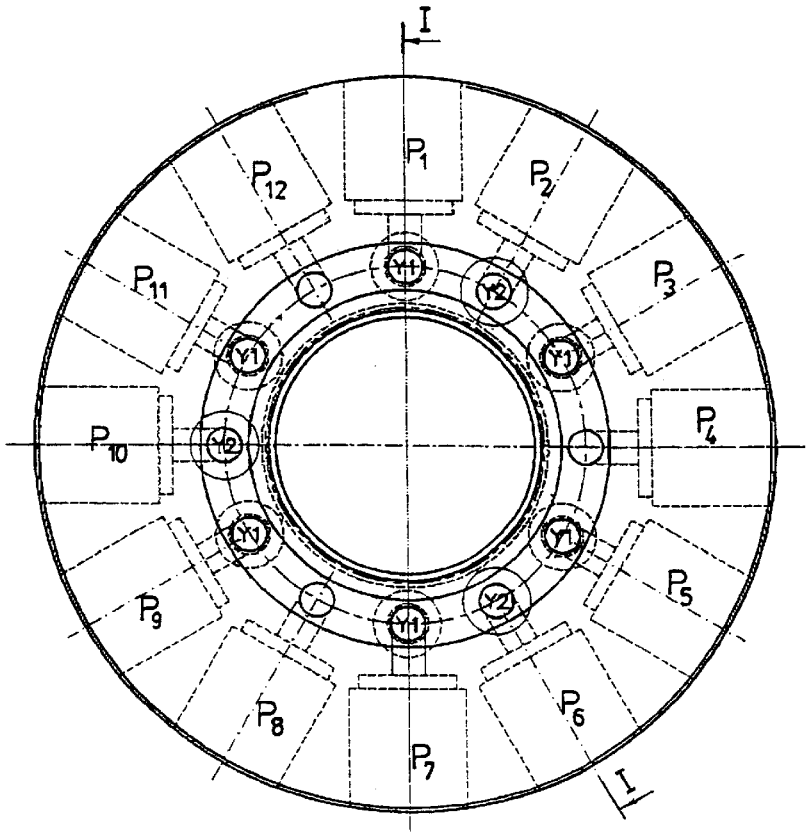
FIG. 5B shows the ⅟₁ revolution volume regulation position.

When no control pressure is conducted into channel $Y_1$ or into channel $Y_2$, all cylinders $P_1$, $P_2$ . . . $P_{12}$ are connected to operate and a so-called full revolution volume regulation position is obtained. The said regulation position is shown in FIG. 5B.

Figure 6A:
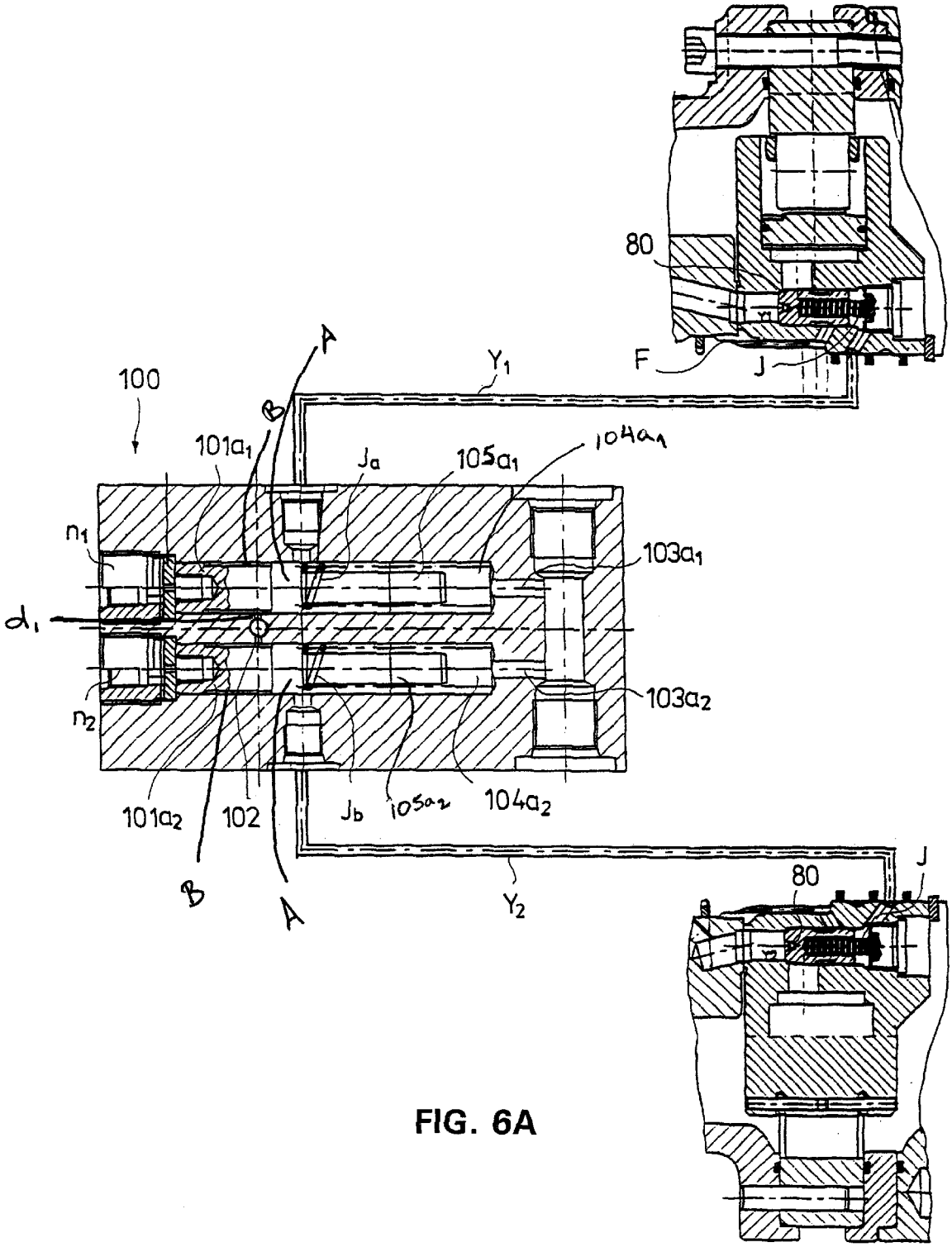
FIG. 6A shows a distributing valve 100 connected to channels $Y_1$ and $Y_2$ used to direct the control pressure supply to channels $Y_1$ and/or $Y_2$. A shut-off valve 70 located in the cylinder body is connected with one channel $Y_1$ to illustrate the operation of the shut-off valve.

FIG. 6A shows an embodiment of the control according to the invention. In accordance with the invention, a distribution valve 100 is used, which includes control pins 101$a_1$, 101$a_2$. The pins can be affected with a control oil pressure or, for example, electrically by using a solenoid. By affecting the pins, a pressure connection with channels $Y_1$ and $Y_2$ is opened and closed. Distribution valve 100 may be located in a fixed position on the end of shaft 14 or it may be a part of shaft 14.

The distribution valve 100 comprises a pair of control pins 101$a_1$, and 101$a_2$, each pin being structured and arranged to fit within a corresponding pin space 104$a_1$ and 104 $a_2$. Each pin 101$a_1$ and 101$a_2$ has an elongated annular groove B formed therein and an end portion 105$a_1$ and 105$a_2$ of reduced diameter extending into the cavity of the pin space. Each pin 101$a_1$ and 101$a_2$ also includes a central portion A located between the annular groove B and the end portion 105$a_1$ and 105$a_2$ of each pin 101$a_1$ and 101$a_2$.

Each of said control pins 101$a_1$ and 101$a_2$ is movable from a first closed position to a second opened position to thereby control the flow of the pressurized medium therethrough. Each of the control pins 101$a_1$ and 101$a_2$ operates in identical fashion thus for purposes of simplicity the description below is directed to the operation of control pin 101$a_1$.

In the solution shown in FIG. 6A, an operating pressure is conducted to valve 10 through its channel 102. By affecting control pins 101$a_1$ and 101$a_2$ at their ends $N_1$, $N_2$ on the pressure side, the pins are moved towards the end of pin space 104$a_1$, 104$a_2$ and a connection for the pressurised medium is opened through channel 102 to channels $Y_2$ and/or $Y_1$. When no control is supplied electrically or hydraulically into pressure spaces $N_1$, $N_2$ at the pin ends, the pins will remain in such a position with the aid of springs $J_a$, $J_b$ located around the pins, which allows a passage for the pressurised medium from control channels $Y_2$, $Y_1$ through outlet lines 103$a_1$, 103$a_2$ to the engine's outlet line.

In operation, channel 102 supplies a pressurized medium which is fed into channel $Y_1$, the flow of pressurized medium into channel $Y_1$ is controlled by pin 101$a_1$. Channel 102 communicates with pin space 104$a_1$ in which pin 101$a_1$ is situated said pin space 104$a_1$ further communicating with said channel $Y_1$.

The flow of said pressurized medium from channel 102 to channel $Y_1$ is controlled by pin 101$a_1$. Specifically, in said first closed position of the control pin 101$a_1$, wall "A" of control pin 101$a_1$ is positioned to the left of the opening to channel $Y_1$ to permit a flow of fluid from channel $Y_1$ through pin space 104$a_1$ and out through outlet line 103$a_1$. The wall "A" is maintained in this first closed position by spring Ja exerting a spring force on the wall "A" and preventing the pin 101$a_1$ from moving to the right, as seen in the figure. The position of the control pin 101$a_1$ is moved from the first closed position to a second opened position by overcoming the spring force acting on the wall "A" with a greater force acting on the end $N_1$ of pin 101$a_1$. In the second opened position the wall "A" is moved beyond the opening of channel $Y_1$, i.e. to the right of channel $Y_1$, such that a flow is permitted from channel 102, through a bore "$d_1$", through the annular groove "B" of the pin 101$a_1$ and on to the opening of channel $Y_1$. When the force acting on the end $N_1$ of pin 101$a_1$ is removed, the spring Ja acting on the wall "A" of pin 101$a_1$ forces said pin to return to the first closed position.

Figure 6B:
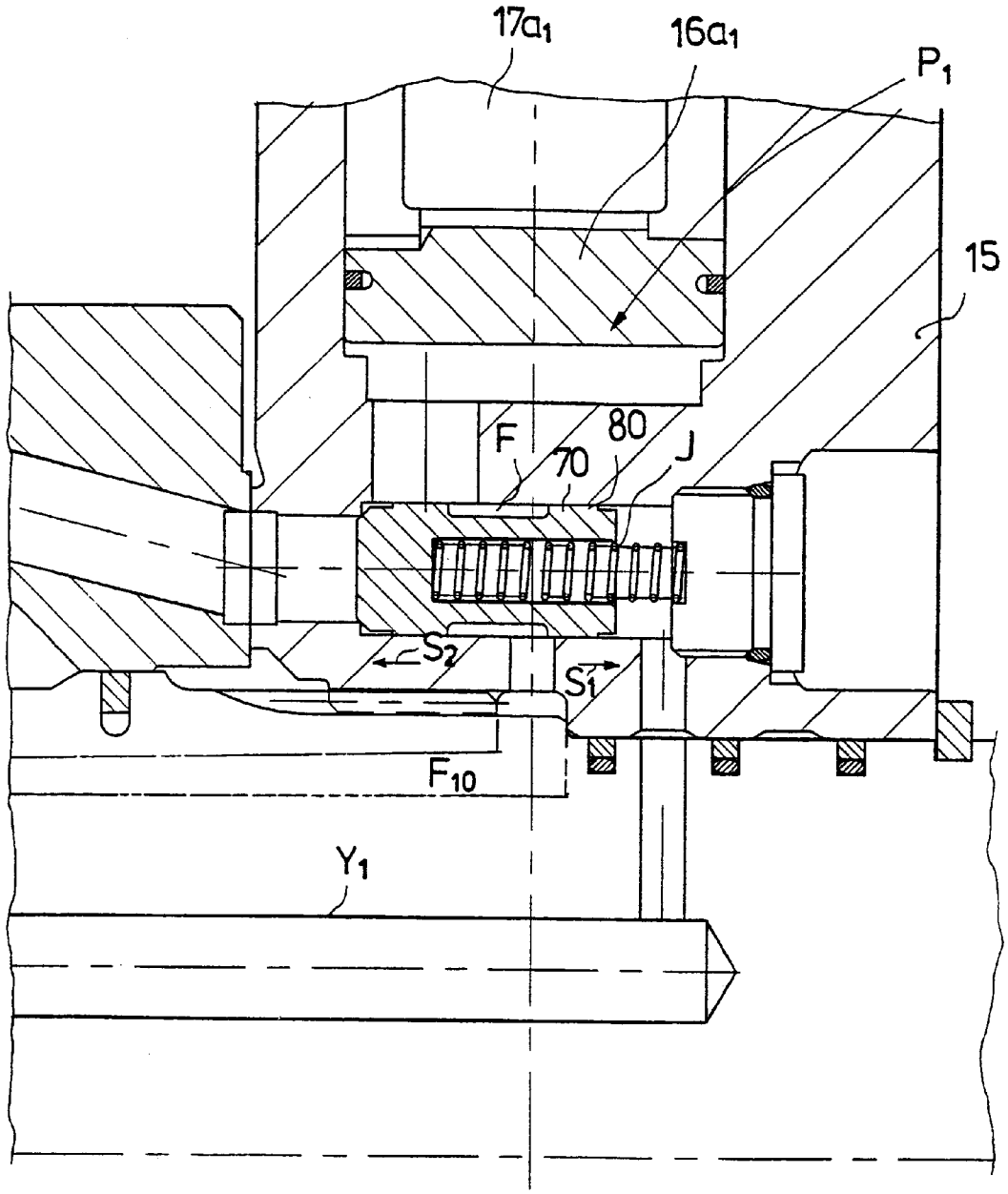
FIG. 6B shows shut-off valve 70 on a larger scale.

FIG. 6B shows the structure of shut-off valve 70 on a larger scale.

As is shown in FIGS. 6A and 6B, control pressure is thus conducted into channels $Y_1$ and/or $Y_2$. As is further illustrated in the figures, the said pressure is conducted to shut-off valve 70 in such a way that it will affect the end face of pin 80 of the shut-off valve. In the normal state, the end face of pin 80 is affected by spring 3, which holds the said shut-off valve 70 in the closed position, when no operating pressure has been conducted to the other side of the pin, and allows oil to flow to outlet $F_{10}$, for example, to the box section through a circumferential central channel F of pin 80. When the pressurised oil affects on the side of spring J of pin 80, the operating pressure is not either able to move the pin 80, and pin 80 will close the passage for the operating pressure to the cylinder $P_1$ or $P_3$ or $P_5$ . . . , which is in connection with shut-off valve 70. When no control pressure is supplied, for example, to channel $Y_1$ as is shown in FIG. 6B, and operating pressure affects the end face of pin 80, the operating pressure moves pin 80, as is indicated by arrow $S_1$ in the figure, to the right and the operating pressure can affect piston 16$a_1$, 16$a_3$ . . . Hereby the connection to outlet $F_{10}$ through the central channel F of pin 80 is closed at the same time. When the operating pressure is effective, it moves pin 80 to the left (arrow $S_2$) as shown in the figure, and the piston space of the cylinder opens to outlet channel $F_{10}$ through the central channel F of pin 80. The spring J is intended to move pin 80 into such a position that the oil space located below the piston will be connected to the outlet at a time when the engine is not under pressure.

When no control pressure is supplied through channels $Y_1$ and/or $Y_2$ to pin 80 of shut-off valve 70 and when the operating pressure has moved pin 80 in the direction indicated by arrow $S_1$ and has opened a passage for the operating pressure to the space below the piston, the pressure existing in the work cycle in question in the space below the piston with shut-off valve 70 in the said position will keep pin 80 pressed in direction $S_1$. This is the case also when the rotated distributor 13 distributes oil to the different work steps and in between connects the oil space below piston 16$a_1$, 16$a_2$ . . . with outlet channel $e_{2B}$, $e_2$ through distributor 13.

The invention is described above referring merely to the advantageous embodiment examples thereof, to the details of which the invention is not, however, intended to be exclusively restricted. A number of modifications and variations are conceivable within the scope of the inventive idea of the claims below. As such, the examples provided above are not meant to be exclusive and many other variations of the present invention would be obvious to those skilled in the art, and are contemplated to be within the scope of the appended claims.

What is claimed is:

1. A radial piston hydraulic engine, comprising:

a rotatable box section;

a cam ring operatively connected to said rotatable box section;

a fixed non-rotary shaft having at least two control pressure channels;

a plurality of cylinder bodies fixedly connected to said non-rotary shaft, each of said plurality of cylinder bodies having a piston structured and arranged therein; wherein a selected number of cylinder bodies have a shut-off valve in communication with said at least two control pressure channels of said non-rotary shaft; said at least two control pressure channels are structured and arranged to selectively supply a control pressure to said shut-off valves of said selected number of cylinder bodies; whereby when said control pressure is supplied to said shut-off valve a selected number of pistons are deactivated;

a distributor connected to said box section and structured and arranged to rotate therewith, said distributor having at least one channel structured and arranged to communicate a pressurized medium from said non-rotary shaft through said shut-off valves to each of said pistons;

an oil space located below said piston and in communication with said shut-off valves;

an outlet channel formed in said non-rotary shaft and in communication with said shut-off valves; and wherein each of said shut-off valves comprise:

a pin having a central annular channel; and wherein said pin is movable between a first position, in which said central channel of said pin is aligned with said outlet channel and permits a communication between said oil space located below said piston and said outlet channel, and a second position, in which said central channel is out of alignment with said outlet channel thereby preventing a communication between said oil space and said outlet channel.

2. The radial piston hydraulic engine according to claim 1, further comprising:

a distributing valve in communication with said at least two pressure channels, said distributing valve comprising at least one control pin structured and arranged to selectively regulate a supply of said pressurized medium into said at least two pressure channels to thereby control said shut-off valves of said selected number of cylinder bodies.

3. The radial piston hydraulic engine according to claim 1, further comprising:

at least two ring channels formed in an outer periphery of said non-rotary shaft structured and arranged to communicate with a selected number of said shut-off valves of said cylinder body; and wherein a one of said at least two control pressure channels is structured and arranged to communicate with a one of said at least two ring channels and wherein an other of said at least two control pressure channels is structured and arranged to communicate with an other of said at least two ring channels.

4. The radial piston hydraulic engine according to claim 1, further comprises:

a spring structured and arranged between an end face of said pin and said cylinder body; and wherein said control pressure conducted from said control channels is directed to said end face abutting said spring.

5. A radial piston hydraulic engine, comprising:

a rotatable box section;

a cam ring operatively connected to said rotatable box section;

a fixed non-rotary shaft having at least two control pressure channels;

a plurality of cylinder bodies fixedly connected to said non-rotary shaft, each of said plurality of cylinder bodies having a piston structured and arranged therein; wherein a selected number of cylinder bodies have a shut-off valve in communication with said at least two control pressure channels of said non-rotary shaft; said at least two control pressure channels are structured and arranged to selectively supply a control pressure to said shut-off valves of said selected number of cylinder bodies; whereby when said control pressure is supplied to said shut-off valve a selected number of pistons are deactivated;

a distributor connected to said box section and structured and arranged to rotate therewith, said distributor having at least one channel structured and arranged to communicate a pressurized medium from said central non-rotary shaft through said shut-off valves to each of said pistons;

wherein a first of said at least two pressure control channels conducts said control pressure to a first selected plurality of shut-off valves corresponding to a first selected plurality of said cylinder bodies;

wherein a second of said at least two pressure control channels conducts said control pressure to a second selected plurality of shut-off valves corresponding to a second selected plurality of said cylinder bodies; and further comprising:

a third selected plurality of cylinder bodies having no shut-off valve in communication therewith, whereby a control pressure is conducted from said distributor to said third selected plurality of cylinder bodies at all times.

* * * * *